US007690813B2

(12) United States Patent
Kanamori et al.

(10) Patent No.: US 7,690,813 B2
(45) Date of Patent: Apr. 6, 2010

(54) LED ILLUMINATION LAMP DEVICE

(75) Inventors: Masayoshi Kanamori, Higashi Kunitachi (JP); Sadato Imai, Hachiouji (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 34 days.

(21) Appl. No.: 11/415,414

(22) Filed: May 2, 2006

(65) Prior Publication Data

US 2006/0256557 A1 Nov. 16, 2006

(30) Foreign Application Priority Data

May 2, 2005 (JP) ..... P2005-133912

(51) Int. Cl.
*F21S 4/00* (2006.01)
*F21V 29/00* (2006.01)

(52) U.S. Cl. ..... 362/249.02; 362/249.01; 362/249.04; 362/373; 362/294; 362/345; 362/235; 362/240; 361/704; 361/707; 361/719; 361/720; 361/725

(58) Field of Classification Search ..... 362/249.01–249.04, 227, 235, 252, 240, 362/373, 294, 547, 345; 361/704, 707, 719, 361/720, 725
See application file for complete search history.

(56) References Cited

U.S. PATENT DOCUMENTS

| | | | | |
|---|---|---|---|---|
| 7,014,336 | B1 * | 3/2006 | Ducharme et al. | 362/231 |
| 7,014,337 | B2 * | 3/2006 | Chen | 362/240 |
| 7,303,315 | B2 * | 12/2007 | Ouderkirk et al. | 362/294 |
| 2005/0174769 | A1 * | 8/2005 | Yong et al. | 362/235 |

FOREIGN PATENT DOCUMENTS

| | | |
|---|---|---|
| JP | 2004-296245 | 10/2004 |
| JP | 2004-296249 | 10/2004 |
| JP | 2004-342574 | 12/2004 |

* cited by examiner

*Primary Examiner*—Sharon E Payne
*Assistant Examiner*—Sean P Gramling
(74) *Attorney, Agent, or Firm*—Browdy and Neimark, PLLC

(57) ABSTRACT

An LED illumination lamp device, including a polygonal-prism-shaped supporting member having a plurality of rectangular side surfaces, plate-like wing members configured to project outwardly from each of ridge lines formed by two adjacent rectangular side surfaces of the supporting member and having at least two opposing rectangular surfaces, and a plurality of LED elements disposed on the rectangular side surfaces of the supporting member and the rectangular surfaces of the wing members.

3 Claims, 6 Drawing Sheets

LED ILLUMINATION LAMP DEVICE

CROSS-REFERENCE TO THE RELATED APPLICATION

This application is based on and claims priority from Japanese Patent Application No. 2005-133912, filed on May 2, 2005, the disclosure of which is incorporated herein by reference in its entirety.

BACKGROUND OF THE INVENTION

1. Field of the Invention

The present invention relates to an LED illumination lamp device for use as an illumination lamp for general lighting, a headlight for vehicle, or the like.

2. Description of Related Art

An LED illumination lamp device using a light emitting diode element (hereinafter, referred to as LED element) has the advantageous effects of a lower heat release value, a longer operating life, and so on, in comparison with a conventional illumination lamp without using LED elements such as an electric light bulb. In recent years, LED illumination lamps have been widely used in various circles as illumination lamps for general lighting, headlights for vehicle, or the like. Because one LED element emits only a small volume of light, it has become conventional practice to install a large number of LED elements in one illumination lamp to ensure emission of a large volume of light.

A known example of an LED illumination lamp is the bulb-type LED illumination lamp in which a large number of LED elements are disposed on a side surface of a cylindrical supporting member to form an electric light bulb (for reference, see Japanese Patent Laid-Open No. 2004-296245, FIG. 1, paragraphs 0014 to 0021, Japanese Patent Laid-Open No. 2004-296249, FIG. 1, paragraphs 0012 to 0019, and Japanese Patent Laid-Open No. 2004-342574, FIGS. 1 to 3, paragraphs 0009 to 0014, and so on).

However, when installing a large number of LED elements in the above-mentioned conventional bulb-type LED illumination lamp, it has been necessary to increase either the diameter or length of the cylindrical supporting member. Therefore, the conventional bulb-type LED illumination lamp has been limited in its ability to assure bright illumination while maintaining a compact size.

SUMMARY OF THE INVENTION

An object of the present invention is to provide an LED illumination lamp device having sufficient brightness even if it is small in size.

To accomplish the above object, an LED illumination lamp device according to one embodiment of the present invention includes a polygonal-prism-shaped supporting member having a plurality of rectangular side surfaces, plate-like wing members configured to project outwardly from each of ridge lines formed by two adjacent rectangular side surfaces of the supporting member and having at least two opposing rectangular surfaces, and a plurality of LED elements disposed in three dimensions on the rectangular side surfaces of the supporting member and the rectangular surfaces of the wing members.

In one embodiment, a plurality of LED elements are assembled in one LED unit. The plurality of LED units are disposed on each of the rectangular side surfaces of the supporting member and the rectangular surfaces of each of the wing members.

With the present invention, because the wing members are provided to project outwardly from the ridge lines of the polygonal-prism-shaped supporting member and the LED elements are provided not only on the rectangular side surfaces of the supporting member but also on the rectangular surfaces of the wing members, it is possible to assure bulb-type LED illumination device which is sufficiently bright in spite of the compact size of the supporting member.

DETAILED DESCRIPTION OF THE PREFERRED EMBODIMENTS

Preferred embodiments of the present invention will be described in detail below with reference to the accompanying drawings.

Figure 1:
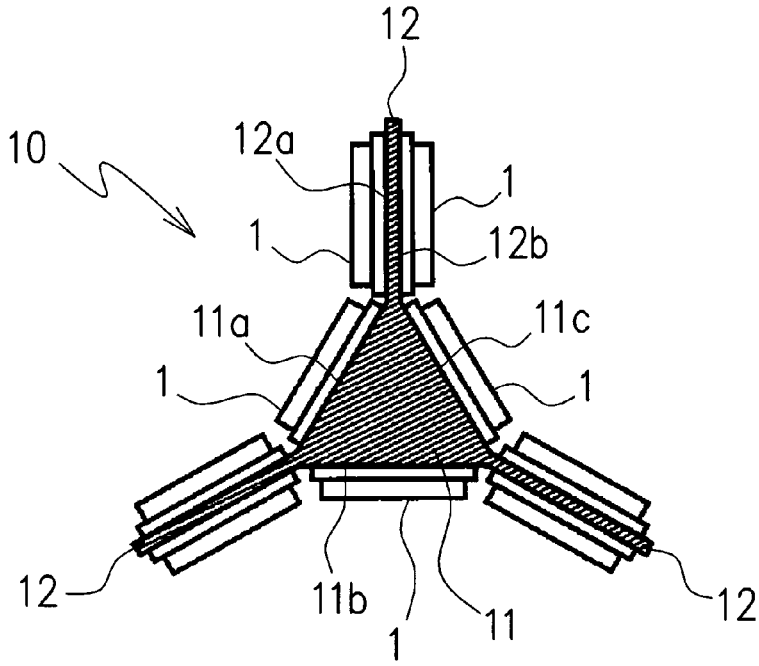
FIG. 1 is a sectional view showing a first embodiment of an LED illumination lamp device according to the present invention.

FIG. 1 illustrates a first embodiment of an LED illumination lamp device according to the present invention.

The first embodiment consists of a bulb-type LED illumination lamp device 10 which contains, for example, a triangular-prism-shaped supporting member 11, three rectangular wing members 12 provided on peripheral ridge lines of the supporting member 11, and a plurality of LED units 1 provided on the supporting member and the wing members 12, as shown in FIG. 1.

More specifically, the supporting member 11 has rectangular side surfaces 11*a* to 11*c* extending to form a triangular prism shape (see FIG. 1). In this embodiment, the supporting member 11 is made of a solid material having a triangular shape in section.

The three rectangular wing members 12 are provided to project outwardly from ridge lines each of which is formed by adjacent side surfaces of the supporting member 11. Each of the wing members 12 includes two opposing or back-to-back rectangular surfaces 12*a* and 12*b*.

The plurality of LED units 1 is provided on the rectangular side surfaces 11*a* to 11*c* of the supporting member 11 and the rectangular surfaces 12*a* and 12*b* of each of the wing members 12.

In this embodiment, the wing members 12 are integrally formed with the supporting member 11 and made of a metallic material such as copper alloy, aluminum, iron or the like having high heat conductivity. Therefore, heat generated in the plurality of LED units 1 can be efficiently released through the supporting member 11 and the wing members 12.

In addition, if the supporting member 11 is formed as a hollow triangular cylinder, an even greater heat release effect can be achieved.

Of course, the wing members 12 may be formed separately from the supporting member 11 and secured to the supporting member 11 by a fixing method such as welding or the like.

Moreover, in this embodiment, the size of each of the rectangular surfaces 12*a* and 12*b* of each wing member 12 is generally similar to that of each of the rectangular side surfaces 11*a* to 11*c* of the supporting member 11. Accordingly, LED units having the same size can be disposed on each of the side surfaces 11*a* to 11*c* of the supporting member 11 and each of the rectangular surfaces 12*a* and 12*b* of each wing member 12.

However, the size of each of the rectangular surfaces 12*a* and 12*b* is not limited to be the same as that of each of the rectangular side surfaces 11*a* to 11*c*.

Figure 4:
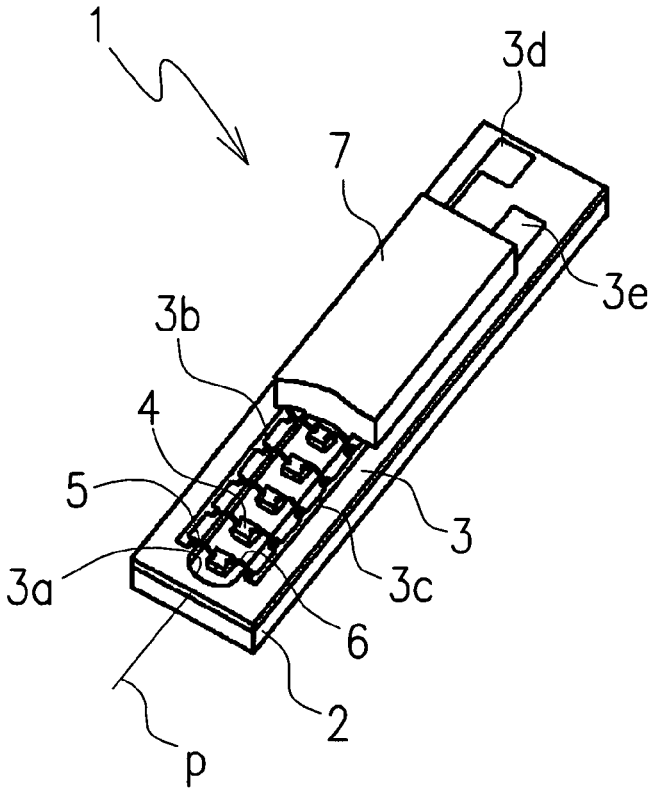
FIG. 4 is a partially broken perspective view showing one example of an LED unit used in the LED illumination lamp device according to the present invention.

Each of the LED units 1 constitutes one among a plurality of light source sections of the LED illumination lamp device 10. A detailed structure of the LED unit 1 is shown in FIG. 4. The LED unit 1 as shown in FIG. 4 includes a rectangular parallelepiped-shaped base 2 made of a metallic material having high heat conductivity, for example, copper alloy and a circuit board 3 mounted on the base 2. The base 2 has a rectangular shape in plan view to be disposed on side surfaces and rectangular surfaces so as to extend the long side of the rectangular shape along a central axis of the supporting member 11. Each of the ridge lines of the supporting member 11 is configured to form a long side of the rectangular surface of each of the wing members.

A hole 3*a* is formed in the circuit board 3 and extended longitudinally along the base 2 at a central portion of the circuit board 3. In the hole 3*a*, a plurality of LED elements 4 are disposed on an upper surface of the base 2 at regular intervals. Moreover, a pair of circuit patterns 3*b* and 3*c* are disposed along opposite sides of the circuit board 3, and terminal electrodes 3*d* and 3*e* are provided at one end of the circuit board, extending from the circuit patterns 3*b* and 3*c*, respectively. The plurality of LED elements 4 are electrically connected through thin metallic lines to the circuit patterns 3*b* and 3*c*, respectively.

Meanwhile, the number of LED elements 4 can be freely adjusted in accordance with the size of the base 2.

In this embodiment, a compact LED unit 1 can be achieved because the LED elements 4 are arranged in series along the longitudinal direction of the base 2, but it is of course also possible to arrange the LED elements 4 side by side in two arrays or more.

The LED elements 4 and the circuit patterns 3*b* and 3*c* are sealed by a transmissive resinous body 7 provided to cover the base 2 from above. The terminal electrodes 3*d* and 3*e* provided at the one end of the circuit board 3 are configured in such a way that they are exposed from the resinous body 7 and may be connected through a socket (not shown) to external electrode terminals or the like, when the LED units 1 are attached to the rectangular side surfaces 11*a* to 11*c* of the supporting member 11 and the rectangular surfaces 12*a* and 12*b* of the wing members 12.

Figure 2:
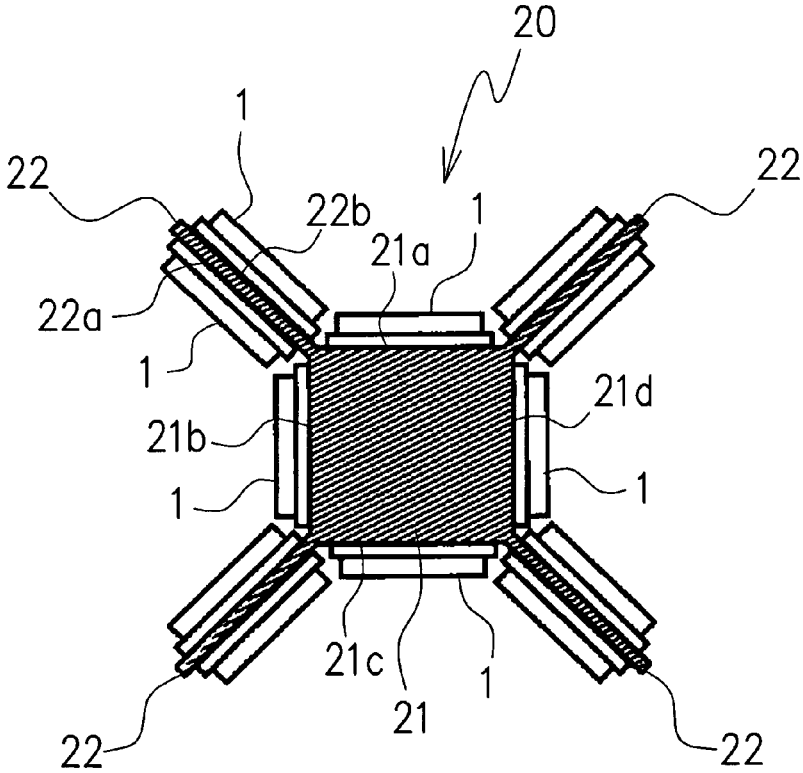
FIG. 2 is a sectional view showing a second embodiment of the LED illumination lamp device according to the present invention.

FIG. 2 illustrates a second embodiment of the LED illumination lamp device according to the present invention.

The LED illumination lamp device 20 in this embodiment is of a bulb type similar to the bulb type as mentioned in the first embodiment. As shown in FIG. 2, the LED illumination lamp device 20 includes a quadrangular-prism-shaped or square-prism-shaped supporting member 21 and four rectangular wing members 22 configured to project from four ridge lines formed by adjacent side surfaces of the supporting member 21. Accordingly, the LED illumination lamp device 20 in the second embodiment is similar in structure to the LED illumination lamp device 10 in the first embodiment, except for the point that the number of LED units 1 disposed on the four side surfaces 21*a* to 21*d* of the supporting member 21 and the rectangular surfaces 22*a* and 22*b* of each wing member 22 is three more than that in the first embodiment.

Accordingly, identical reference numbers are attached to parts of the LED illumination lamp device 20 similar to those of the LED illumination lamp device 10, and a detailed description of the similar parts is omitted. In addition, the structure of each LED unit 1 as used in the second embodiment may be the same as that of those used in the first embodiment as shown in FIGS. 1 and 4.

Figure 3:
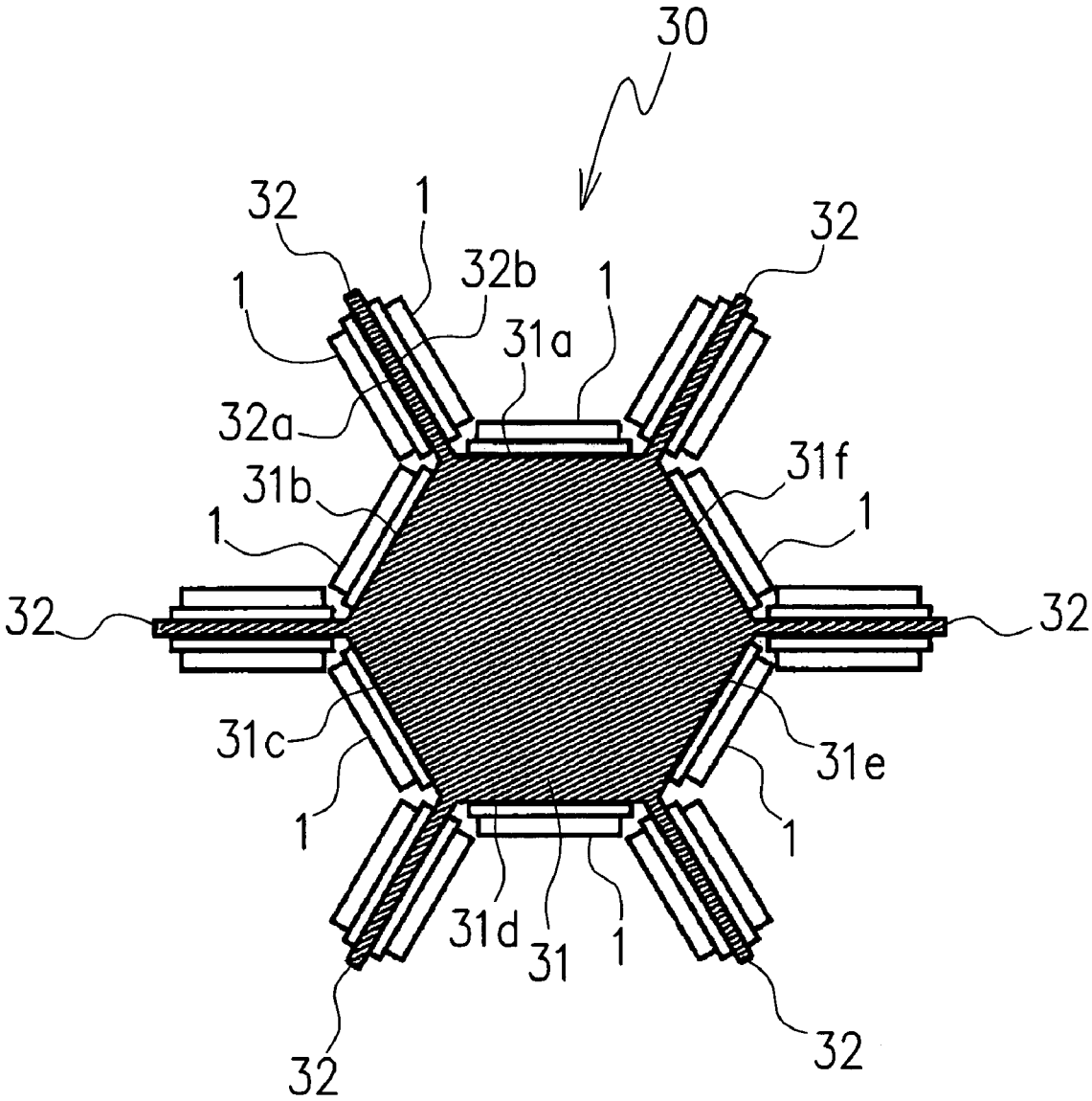
FIG. 3 is a sectional view showing a third embodiment of the LED illumination lamp device according to the present invention.

FIG. 3 illustrates a third embodiment of the LED illumination lamp device according to the present invention.

The LED illumination lamp device 30 in the third embodiment includes a hexagonal-prism-shaped supporting member 31 and six rectangular wing members 32 configured to project from ridge lines formed by adjacent side surfaces of the supporting member 31. Accordingly, the LED illumination lamp device 30 in the third embodiment is similar in structure to the LED illumination lamp device 10 in the first embodiment, except for the point that the number of LED units 1 disposed on the six side surfaces 31*a* to 31*f* of the supporting member 31 and the rectangular surfaces 32*a* and 32*b* of each wing member 32 can be doubled, compared with the first embodiment.

Accordingly, identical reference numbers are attached to parts of the LED illumination lamp device 30 similar to those of the LED illumination lamp device 10, and a detailed description of the similar parts is omitted. In addition, the structure of each LED unit 1 as used in the third embodiment is also the same as that of those used in the first embodiment as shown in FIGS. 1 and 4.

Next, an explanation is given about a light distribution characteristic of the bulb-type LED illumination lamp device in each of the above-mentioned embodiments.

Figure 5:
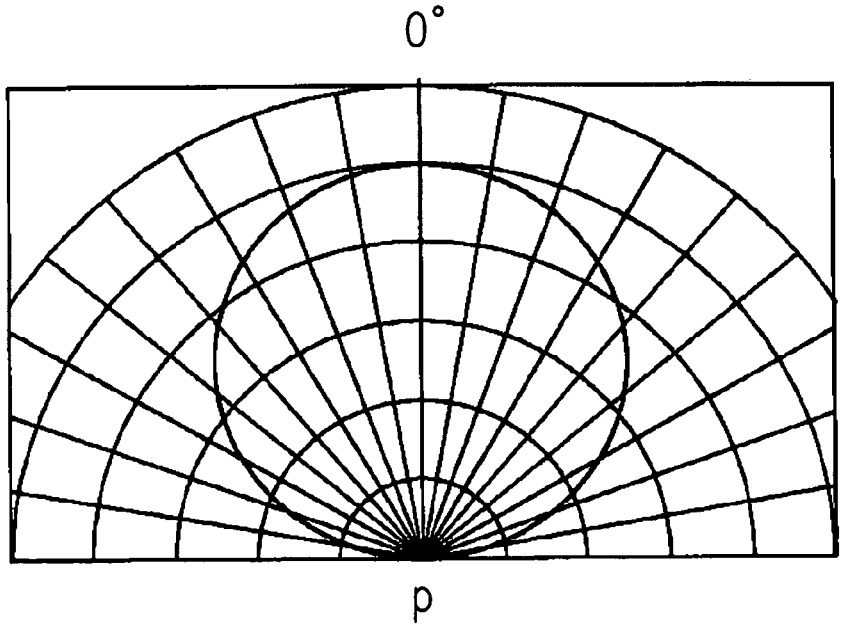
FIG. 5 is a graph showing a light distribution characteristic of the LED unit.

FIG. 5 is a graph showing a light distribution characteristic of each LED element used in an LED unit 1. In the light distribution characteristic, light going straight from an emission center p of each LED element is highest in intensity, and is totally distributed to diffuse in a range of 180 degrees forward of the surface of the base on which a plurality of LED elements are mounted (see FIGS. 4 and 5).

Figure 6:
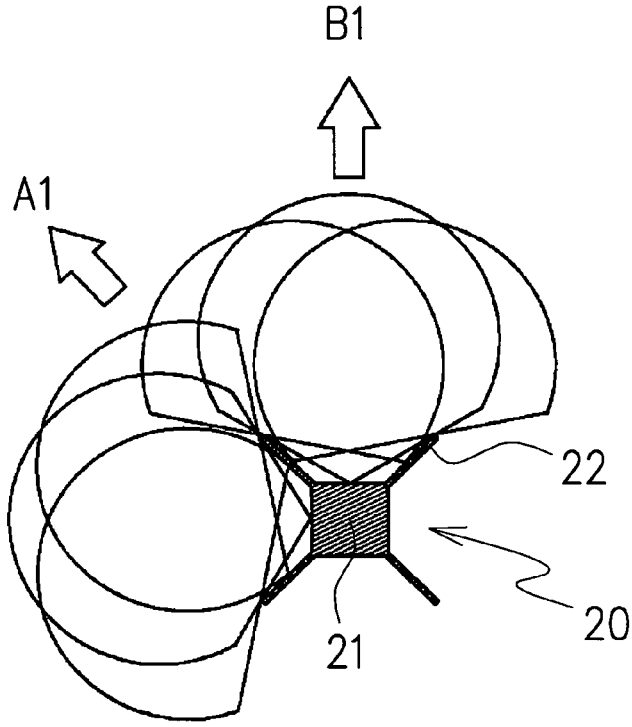
FIG. 6 is an explanatory diagram showing a light distribution characteristic of the LED illumination lamp device according to the second embodiment.
Figure 7:
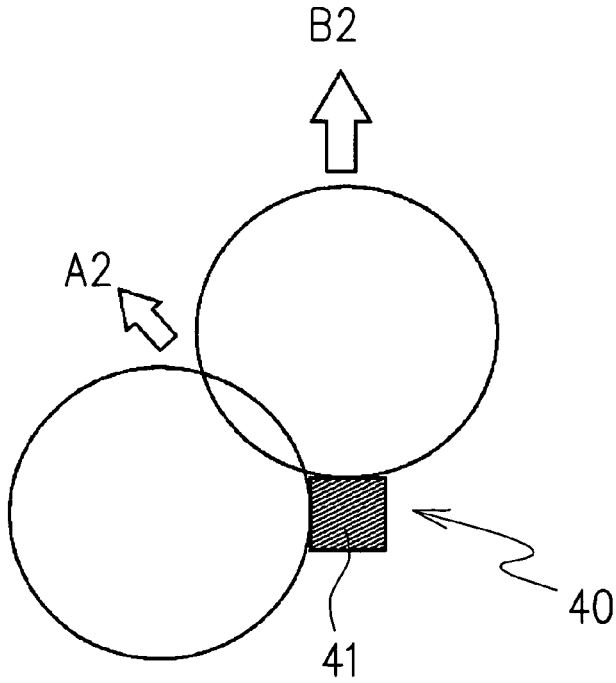
FIG. 7 is an explanatory diagram showing a light distribution characteristic of a conventional LED illumination lamp compared with the light distribution characteristic shown in FIG. 6.

FIG. 6 illustrates a light distribution characteristic of the LED illumination lamp device 20 which includes the supporting member 21 and the wing members 22, according to the second embodiment. FIG. 7 illustrates a light distribution characteristic of a conventional LED illumination lamp device 40 having only a square-prism-shaped supporting member 41, and without any of the above-mentioned wing members.

Further, the above-mentioned LED units 1 are also disposed on four rectangular side surfaces of the supporting member 41 of the conventional LED illumination lamp device 40. Comparing the LED illumination lamp device 20 according to the present invention with the bulb-type LED illumination lamp device 40, the LED illumination lamp device 20 according to the present invention makes it possible to provide three times as many LED units 1 as in the conventional LED illumination lamp device 40 even if the square-prism-shaped supporting member has the same shape as that in the conventional LED illumination lamp 40, because the LED illumination lamp device 20 is provided with wing members 22. Consequently, the LED illumination lamp device according to the present invention can be three times as bright as the conventional LED illumination lamp device, in spite of using a supporting member having a same size.

Meanwhile, as shown in FIG. 6, there is the possibility that a part of the light emitted from a central portion of each of the rectangular side surfaces of the supporting member 21 is obscured by the rectangular surfaces of the wing members 22. Therefore, by using wing members 22 including rectangular surfaces of small width and LED units 1 of small width, the light emitted from the rectangular side surfaces of the supporting members 21 can avoid being-obscured by the rectangular surfaces of the wing members 22 so that the LED illumination lamp device 20 is configured to emit bright light.

In the conventional LED illumination lamp device 40, as is clear from FIG. 7, light emitted obliquely from each of the rectangular side surfaces of the supporting member 41 (light emitted in the direction shown by arrow A2) has lower intensity and wider distribution than light emitted straight from each of the rectangular side surfaces of the supporting member 41 (light emitted in the direction shown by arrow B2). This is because the light indicated by arrow B2 is distributed as shown in a circle, whereas the light indicated by arrow A2 is distributed as shown in a narrow area between the adjacent circles (see FIG. 7).

In the LED illumination lamp device 20 according to the present invention, as is clear from a distribution shown in FIG. 6, light emitted obliquely from each of the rectangular side surfaces of the supporting member 21 (light emitted in the direction shown by arrow A1) has generally the same intensity and distribution area as light emitted straight from each of the rectangular side surfaces of the supporting member 21 (light emitted in the direction shown by arrow B1), due to the effect of the LED units disposed on the rectangular surfaces of the wing members 22.

Figure 8:
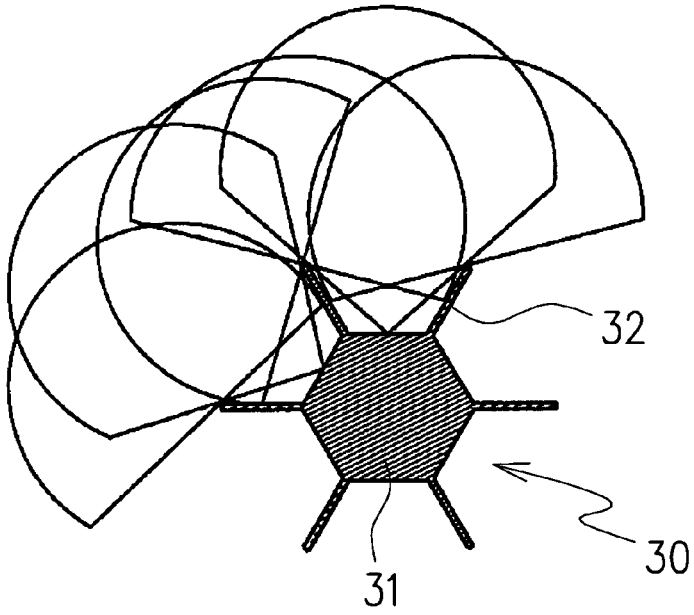
FIG. 8 is an explanatory diagram showing a light distribution characteristic of the LED illumination lamp device according to the third embodiment.
Figure 9:
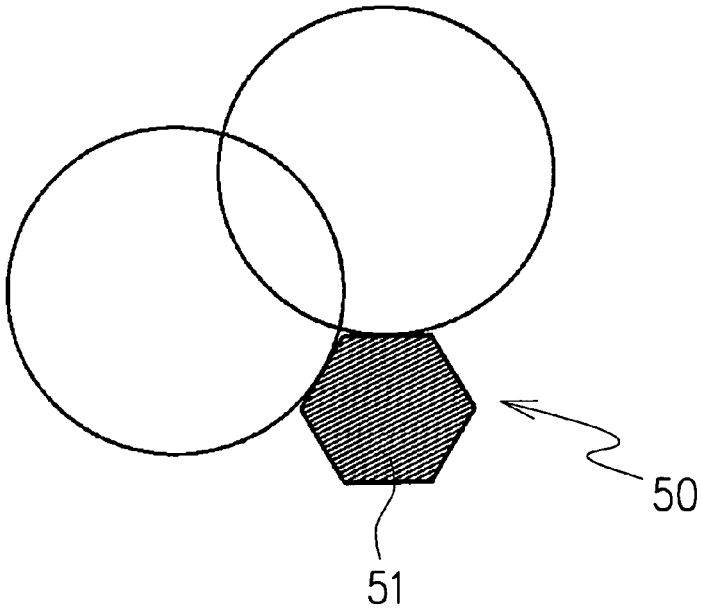
FIG. 9 is an explanatory diagram showing a light distribution characteristic of a conventional LED illumination lamp compared with the light distribution characteristic shown in FIG. 8.

FIG. 8 illustrates a light distribution characteristic of the LED illumination lamp device 30 which includes the supporting member 31 and the wing members 32, according to the third embodiment. FIG. 9 illustrates a light distribution characteristic of a conventional LED illumination lamp 50 having only a hexagonal-prism-shaped supporting member 51, and without any of the above-mentioned wing members.

As a result of comparison of the two light distribution characteristics, by providing the wing members, in the same way as in the second embodiment, the LED illumination lamp device 30 can be configured to include tripled number of LED units, compared with the conventional LED illumination lamp, even if the hexagonal supporting member has the same size. Consequently, an LED illumination lamp device according to the present invention can have threefold brightness, compared with the, conventional bulb-type illumination lamp. In the third embodiment, it is preferable to use wing members having rectangular surfaces and LED units of small width because there is the possibility that a part of the light emitted from a center portion of each of the rectangular side surfaces of the supporting member 31 may be blocked by the rectangular surfaces of the wing members 32.

As is clear from comparison of the light distribution characteristics as shown in FIGS. 6 and 8, when more rectangular side surfaces of the supporting member are used; it is possible to achieve more overlap light illuminating portions and enhanced density of the light emitted from the LED units disposed on the rectangular side surfaces and the LED units disposed on the rectangular surfaces of the adjacent wing members, and thus an LED illumination lamp device according to the present invention can obtain light of uniform brightness emitted in all directions.

Also, if LED units 1 having similar quality and size are disposed on a polygonal-prism-shaped supporting member having wing members, the more side surfaces the supporting member has, the more wing members can be disposed. Consequently, the LED units can be effectively disposed in three dimensions.

As is clear from comparison of the LED lamp devices 10, 20 and 30 as shown in FIGS. 1, 2 and 3, because the number of wing members and LED units 1 disposed on the wing members increases as the number of angles of the polygonal prism-shaped supporting member increases, a brighter light source can be obtained.

Figure 10:
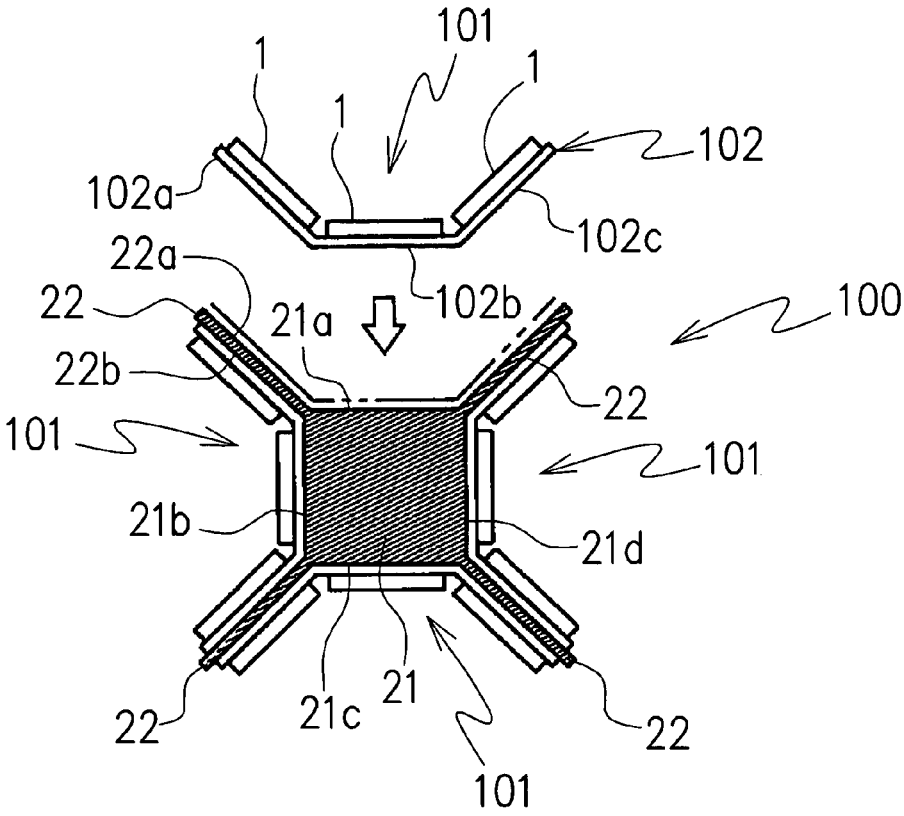
FIG. 10 is a sectional view showing a fourth embodiment of the LED illumination lamp device according to the present invention.

FIG. 10 illustrates a fourth embodiment of the LED illumination lamp device according to the present invention.

The LED illumination lamp device 100 in this embodiment includes a square-prism-shaped supporting member 21 and four wing members 22 projected from ridge lines formed on four angular portions of the supporting member 21, similar to the LED illumination lamp device 20 in the second embodiment. In addition, LED units 1 are disposed on rectangular side surfaces 21*a* to 21*d* of the supporting member 21 and opposite rectangular surfaces 22*a* and 22*b* of each of the wing members 22.

In the fourth embodiment, LED-units-assembly 101, each of which includes three LED units 1, are provided between adjacent wing members. Each of the LED units 1 has the same structure as the LED unit in the second embodiment.

More specifically, each of the LED-units-assembly 101 includes a base 102 formed by one rectangular plate and having a central flat part 102*b* and side flat parts 102*a* and 102*c* extending from both ends of the central flat part 102*b*.

A flexible circuit substrate 103 (see FIG. 3) having three holes (not shown) for mounting LED elements on the base 102 is attached to the base 102. In this embodiment, the flexible circuit substrate 103 is formed in the same shape as the base 102.

Figure 11:
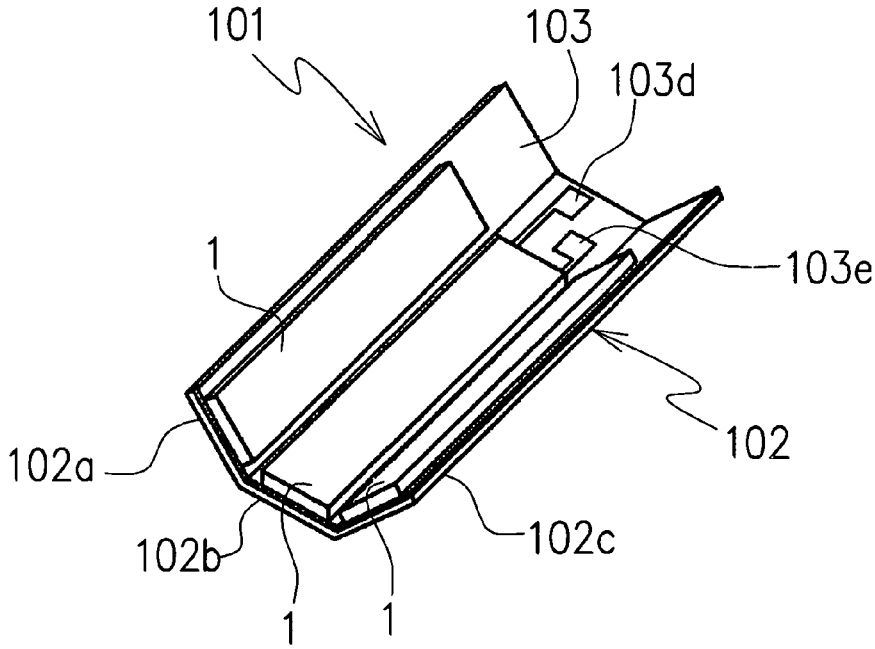
FIG. 11 is a perspective view showing one example of an LED unit used in the fourth embodiment.

The flexible circuit substrate 103 may be divided into three pieces which are disposed on the central flat part 102*b* and the side flat parts 102*a* and 102*c* of the board 102, respectively. After disposing a plurality of LED elements on an upper surface of the base assembly 102 within each hole of a flexible circuit substrate, the LED elements are electrically connected to a pair of terminal electrodes 103*d* and 103*e* collectively. Then, the LED elements provided on each part of the central flat part 102*b* and the side flat parts 102*a* and 102*c* are sealed by a resinous body (not shown), respectively. Furthermore, the side flat parts 102*a* and 102*c* are bent to incline inside, for example, at an angle of 45 degrees, respectively, as shown in FIGS. 10 and 11. Because each LED unit has the same structure as the aforementioned LED unit without the exception of a plurality of LED units sharing a base, a circuit board, and terminal electrodes, a further detailed description is omitted.

By a structure of arranging directly a plurality of LED elements on the central flat part 102*b* and the side flat parts 102*a*, 102*c* of the collection base 102, respectively, and providing a plurality of transmissive resinous bodies, each of which is on each part to cover the LED elements disposed on the central flat part 102*b* and the side flat parts 102*a*, 102*c*. By the way, it is also possible to form the same structure as an assembly in three LED units 1 are combined.

In the LED illumination lamp device according to the fourth embodiment, four LED-units-assemblies 101, each of which has the above-mentioned structure are prepared, and the four prepared LED-units-assemblies 101 are disposed at four predetermined places on the supporting member 21, respectively. Consequently, it is possible to achieve a very easy assembly process for the LED illumination lamp device 100. In addition, because the three LED units 1 arranged in each LED-units-assembly 101 are electrically connected to a pair of terminal electrodes, simple electrical connection structure to any external electrical device can be achieved.

Although the present invention has been applied to LED illumination lamp devices having three dimensional configurations, the present invention can also be applied to an LED illumination lamp other than of the three dimensional configurations.

In addition, various modifications and changes can be made to the above-mentioned preferred embodiments.

What is claimed is:

1. A light-emitting diode illumination lamp device, comprising:

a supporting member that is of a polygonal prism shape and has a plurality of rectangular planar surfaces at a peripheral side surface of the supporting member, the supporting member further including plate-like members each projecting outwardly from each of ridge lines formed by two adjacent rectangular planar surfaces of the supporting member and each of the plate-like members having two opposite rectangular planar surfaces; and a plurality of light-emitting diode units, each of which has three faces each disposed on one of the rectangular planar surfaces at the peripheral side surface of the supporting member and two opposite rectangular planar surfaces that are disposed at both sides of the one of the rectangular planar surfaces, the each of the light-emitting diode units including a base with three rectangular-shaped faces made of a metallic material having a high heat conductivity and, lower surfaces of which are provided on each of the one of the rectangular planar surfaces and the two opposite rectangular planar surfaces that are disposed at both sides of the one of the rectangular planar surfaces, a flexible circuit substrate including three faces and three elongate holes each provided at each of the three faces and passing through the flexible board, and the three faces of the flexible circuit substrate disposed on three-rectangular shaped faces of the base, the flexible circuit substrate including a pair of electrodes provided at one end portion of the flexible circuit substrate, a plurality of light-emitting diode elements arranged on the upper surfaces of the three rectangular-shaped faces of the base in the three elongate holes of the flexible circuit substrate, and the light-emitting diode elements electrically connected to the pair of terminal electrodes.

2. The light-emitting diode illumination lamp device according to claim 1, wherein first and second faces of the three rectangular-shaped faces of the base are disposed at both sides of a third face of the thee rectangular-shaped faces of the base, and the first and second faces are disposed at an angle relative to the third face, respectively.

3. The light-emitting diode illumination lamp device according to claim 2, wherein the angle is 45 degrees.

* * * * *

UNITED STATES PATENT AND TRADEMARK OFFICE

CERTIFICATE OF CORRECTION

PATENT NO. : 7,690,813 B2
APPLICATION NO. : 11/415414
DATED : April 6, 2010
INVENTOR(S) : Kanamori et al.

It is certified that error appears in the above-identified patent and that said Letters Patent is hereby corrected as shown below:

At claim 2, column 8, line 30, delete “thee...” and insert --three--.

Signed and Sealed this
Twenty-second Day of March, 2011

David J. Kappos

David J. Kappos
*Director of the United States Patent and Trademark Office*